US011717457B2

(12) United States Patent
Wiggermann et al.

(10) Patent No.: US 11,717,457 B2
(45) Date of Patent: Aug. 8, 2023

(54) LIFT SYSTEM WITH A STOWABLE SUPPORT ASSEMBLY

(71) Applicant: Liko Research & Development AB, Luleå (SE)

(72) Inventors: Neal Wiggermann, Batesville, IN (US); James Ledwith, Skanneateles Falls, NY (US); Jessica Cushman, Skanneateles Falls, NY (US); Sravan A. Mamidi, Columbus, IN (US); Jesse Newman, Liverpool, NY (US)

(73) Assignee: Liko Research & Development AB, Luleå (SE)

( * ) Notice: Subject to any disclaimer, the term of this patent is extended or adjusted under 35 U.S.C. 154(b) by 717 days.

(21) Appl. No.: 16/278,234

(22) Filed: Feb. 18, 2019

(65) Prior Publication Data

US 2020/0261293 A1 Aug. 20, 2020

(51) Int. Cl.
*A61G 7/10* (2006.01)

(52) U.S. Cl.
CPC ..... *A61G 7/1065* (2013.01); *A61G 7/1015* (2013.01); *A61G 7/1034* (2013.01);
(Continued)

(58) Field of Classification Search
CPC .. A61G 7/1036; A61G 7/1038; A61G 7/1051; A61G 7/1073; A61G 2200/30;
(Continued)

(56) References Cited

U.S. PATENT DOCUMENTS 4,627,119 A * 12/1986 Hachey ..... A61G 7/1015 5/85.1
4,944,056 A * 7/1990 Schroeder ..... A61G 7/1015 5/85.1

(Continued)

FOREIGN PATENT DOCUMENTS

AU 2006235966 A1 * 11/2006 ..... A61G 3/062
CN 105411738 A 3/2016

(Continued)

OTHER PUBLICATIONS

Extended European Search Report for European Application No. 20157011.6 dated Jun. 16, 2020, 8 pages.

*Primary Examiner* — David R Hare
*Assistant Examiner* — Alexis Felix Lopez
(74) *Attorney, Agent, or Firm* — Dinsmore & Shohl LLP

(57) ABSTRACT

A lift system includes a hoist module, a support assembly which is movable relative to the hoist module, and a control system. The control system is adapted to enable a user to a) issue an operational command which causes the support assembly to move to an operational destination, and b) issue a stowage command which causes the support assembly to move to a stowage destination. The control system is also adapted to A) disregard the stowage command provided at least one condition is satisfied and/or B) encumber issuance of the stowage command Equivalently, the control system adaptation is to A1) disregard the stowage command provided at least one stowage contraindication condition is satisfied or A2) not disregard the stowage command provided at least one stowage noncontraindication condition is satisfied and/or B) encumber issuance of the stowage command.

24 Claims, 21 Drawing Sheets

(52) U.S. Cl.
CPC ..... *A61G 7/1051* (2013.01); *A61G 2203/12* (2013.01); *A61G 2203/34* (2013.01); *A61G 2203/46* (2013.01); *A61G 2203/70* (2013.01)

(58) Field of Classification Search
CPC ..... A61G 2200/54; A61G 2200/60; A61G 2210/30
See application file for complete search history.

(56) References Cited

U.S. PATENT DOCUMENTS

| | | | | | |
|---|---|---|---|---|---|
| 5,158,188 | A * | 10/1992 | Nordberg | A61G 7/1015 | 212/312 |
| 5,327,592 | A * | 7/1994 | Stump | A61G 7/1015 | 254/362 |
| 5,456,655 | A * | 10/1995 | Morris | A61G 7/1015 | 128/846 |
| 5,809,591 | A * | 9/1998 | Capaldi | A61G 7/1015 | 5/83.1 |
| 6,006,377 | A | 12/1999 | Asakawa | | |
| 6,523,195 | B1 * | 2/2003 | Rodier | A61G 7/1015 | 104/89 |
| 6,943,663 | B2 * | 9/2005 | Wang | A61B 17/00 | 340/3.7 |
| 7,021,427 | B2 * | 4/2006 | Skovgaard | A61G 7/1015 | 187/281 |
| 7,237,491 | B2 * | 7/2007 | Faucher | A61G 7/1015 | 104/89 |
| 7,350,247 | B2 * | 4/2008 | Bogh-Sorensen | A61G 7/1015 | 5/83.1 |
| 9,902,276 | B2 | 2/2018 | Bianco et al. | | |
| 2010/0192296 | A1 * | 8/2010 | Clough | A61G 7/1051 | 5/83.1 |
| 2015/0030185 | A1 * | 1/2015 | Clough | G16H 40/63 | 381/122 |
| 2015/0056050 | A1 * | 2/2015 | Decuir, Jr. | A61G 7/1046 | 414/550 |
| 2017/0000673 | A1 | 1/2017 | Harmeyer et al. | | |
| 2017/0046620 | A1 * | 2/2017 | Morrison | A61G 7/05761 | |
| 2017/0360635 | A1 * | 12/2017 | Brulotte | A61G 7/1065 | |
| 2020/0085657 | A1 * | 3/2020 | Wiggermann | A61G 7/1051 | |
| 2020/0179204 | A1 * | 6/2020 | Goldman | A61G 7/1046 | |

FOREIGN PATENT DOCUMENTS

| | | | | |
|---|---|---|---|---|
| CN | 106580603 | A | 4/2019 | |
| CZ | 306175 | B6 * | 9/2016 | A61G 1/0275 |
| DE | 8425772 | U1 | 7/1988 | |
| EP | 1090620 | A1 | 4/2001 | |
| EP | 2308440 | A2 * | 4/2011 | A61G 7/015 |
| EP | 2484325 | A2 * | 8/2012 | A61G 7/015 |
| EP | 3123998 | A1 * | 2/2017 | A61G 7/1063 |
| EP | 3622935 | A1 * | 3/2020 | A61H 3/008 |
| GB | 2248817 | A * | 4/1992 | A61G 7/1061 |
| JP | 2007267856 | A | 10/2007 | |
| WO | WO-2016077920 | A1 * | 5/2016 | A61G 7/1051 |

* cited by examiner

LIFT SYSTEM WITH A STOWABLE SUPPORT ASSEMBLY

BACKGROUND

Lift systems are used in hospitals and other settings in connection with care recipients who have a compromised ability to move from place to place on their own. In some circumstances the lift system may bear the entire weight of the person being assisted, for example to transfer the person from a hospital bed to a wheelchair. In other circumstances the lift system may bear only part of the weight of the person, for example to help a weakened person walk from a hospital bed to a nearby lavatory.

One type of lift system includes overhead, longitudinally extending stationary rails supported by structural members of the building, and a laterally extending traverse rail supported on the stationary rails and movable longitudinally along the stationary rails. In this specification "longitudinal" and "lateral" are used merely to distinguish two orthogonal reference directions from each other. The lift system also includes a hoist module which includes a housing and a motor. The hoist module is mounted on the traverse rail so that the hoist module is movable along the length of the rail, i.e. laterally. The lift system also includes a patient support assembly. One example of a patient support assembly includes a tether that can be retracted into or deployed out of the housing in response to operation of the motor, and a slingbar attached to the free end of the tether. The lift system also includes a sling which cradles the person requiring assistance and which can be attached to and removed from the slingbar.

In operation a user, typically a caregiver, positions the sling under the patient, for example when the patient is on a bed, and attaches the sling to the slingbar. The caregiver then operates the motor, by way of a user interface, to retract the tether into the housing thereby raising the sling and lifting the patient from the bed. By pulling on the sling the caregiver moves the hoist along the traverse rail, and/or moves the traverse rail along the primary rails, to move the patient laterally and/or longitudinally until the patient is suspended above a destination. The caregiver then uses the user interface to operate the motor to extend the tether out of the housing thereby lowering the patient to the destination. The lift system may be used to move the patient between any positions within the longitudinal and lateral ranges of the primary and traverse rails.

The caregiver uses a user interface to command a controller to operate the hoist motor. In some systems the interface may be a wall mounted unit and may communicate with the controller over a wired connection or wirelessly. In other systems the user interface may be a hand-held unit suspended by a coiled wire which suspends the user interface from the motor housing and provides communication with the controller. In other systems the user interface may be a stand alone hand-held unit. The stand alone unit is not physically connected to the housing or controller, and communicates wirelessly with the controller. Both the suspended and stand alone units may include a hook or some other device so that the unit can be stored at a storage site on the tether or slingbar. A given lift system may be provided with only one type of the three types of user interface (wall mounted, hand-held wired/suspended, hand-held stand alone), or with two or more types.

The user interface includes user interface elements that the caregiver or other user employs to command the hoist motor to retract or extend the tether. For example, the user interface may include an UP button (switch) and a DOWN button (switch). The user issues a command to retract or extend the tether by actuating the switch, e.g. by pressing the UP or DOWN button with a finger or thumb. When the tether and slingbar reach the desired height, the user rescinds the command by taking an overt action. In one example the button is a momentary switch in the form of a push button, and the overt action is releasing the button. In another example the button is a latching switch in the form of a push button, and the overt action is a second actuation of the switch. Momentary and latching switches are described briefly below.

In many user interfaces for lift systems the UP and DOWN switches are normally-open momentary switches. A momentary switch is a switch that is engaged (closed or open) only while a user is pressing it. Momentary switches offer the advantage that motor operation occurs only while the user maintains pressure on the switch, thereby avoiding "runaway", unintended, or unattended operation. One disadvantage of a momentary switch is related to the fact that when a caregiver is finished using the equipment, it is desirable for the caregiver to park the tether and slingbar at a high enough elevation that they are not a hazard, annoyance, or inconvenience to people in the room. The user accomplishes this by commanding at least partial retraction of the tether into the hoist housing. The user may choose to park the tether and slingbar as high as the system will allow or may select a lower parking elevation. However, either way the parking height is at the discretion and judgement of the user, rather than a predefined height which is preprogrammed into the system and therefore highly repeatable by design.

Unfortunately, caregivers working under time constraints may be reluctant to take the time necessary to keep pressure on the button until the slingbar is at a sufficiently high elevation. The tether and slingbar are thus left in an undesirable state, i.e. at too low of an elevation rather than parked high and out of the way.

Other user interfaces may use latching switches, which are sometimes referred to as maintained switches. A latching switch, once actuated to its ON state, remains in the ON state until some action occurs to change its polarity back to the OFF state. Similarly, once a latching switch is actuated to its OFF state it remains in the OFF state until some action occurs to change its polarity back to the ON state. The change of polarity may be affected by, for example, a second actuation of the switch or by signalling the switch that a task corresponding to its present state has been accomplished. If the lift system includes provisions for automatically stopping the motor once the tether and slingbar reach a predefined stowage position (i.e. elevation), and if the UP button is a latching switch, the caregiver can use the latching UP button to get the stowage task underway but will not have to remain present awaiting completion of the stowage event.

Use of a latching switch rather than a momentary switch may dispense with the problem of caregiver reluctance to take the time required to retract the tether and elevate the slingbar to a predefined stowage elevation. However, if the user interface is storable at a storage site on the tether or slingbar, the caregiver may actuate the latching switch and then, while the storage site is still within reach, place the user interface at the storage site. If the predefined elevation is high enough, the user interface will then be out of reach for the next person who wishes to use it. If the storable user interface is the only interface available special measures will have to be taken to retrieve the user interface, for example waiting until a maintenance worker arrives with a ladder.

In view of the foregoing there is an evident need for a user interface that can used to conveniently stow the support assembly of a lift system at a predefined elevation which is not at the discretion of the user. There is also an evident need for a storable user interface that is storable at a storage site on the support assembly, but which will not travel with support assembly to an inaccessible elevation when the support assembly is commanded to move to its predefined stowage elevation.

SUMMARY

One embodiment of a lift system described herein includes a hoist module, a support assembly which is movable relative to the hoist module, and a control system. The control system is adapted to enable a user to a) issue an operational command which causes the support assembly to move to an operational destination, and b) issue a stowage command which causes the support assembly to move to a stowage destination. The control system is also adapted to A) disregard the stowage command provided at least one condition is satisfied and/or B) encumber issuance of the stowage command.

Another embodiment of a lift system described herein includes a hoist module, a support assembly which is movable relative to the hoist module, and a control system. The control system includes one or more operational interface elements adapted to enable a user to issue a first operational command to increase elevation of the support assembly and a second operational command to decrease elevation of the support assembly. The first operational command and the second operational command each remain in effect only as long as the user maintains actuation of the interface element. The control system also adapted to enable the user to issue a stowage command which differs from the operational commands.

BRIEF DESCRIPTION OF THE DRAWINGS

The foregoing and other features of the various embodiments of the lift system described herein will become more apparent from the following detailed description and the accompanying drawings in which.

DETAILED DESCRIPTION

Figure 1:
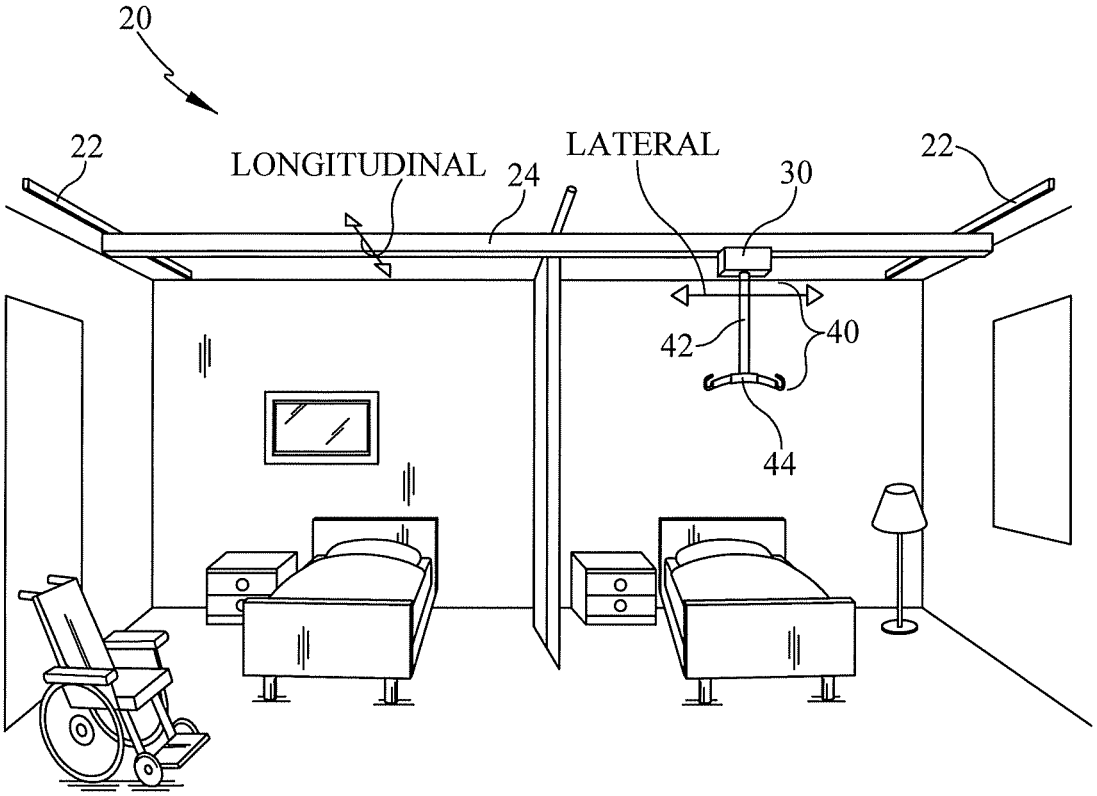
FIG. 1 is a view of a hospital room which includes a lift system.

In this specification and drawings, features similar to or the same as features already described may be identified by reference characters or numerals which are the same as or similar to those previously used. Similar elements may be identified by a common reference character or numeral, with suffixes being used to refer to specific occurrences of the element. Examples given in this application are prophetic examples.

Figure 2:
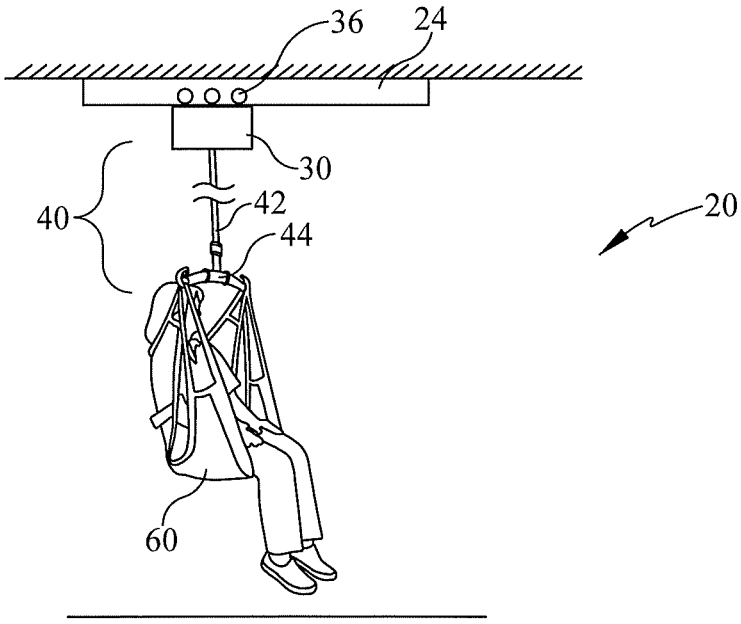
FIG. 2 is a view of selected components of a lift system showing a patient cradled in a sling component thereof.

Referring to FIGS. 1-2, a lift system 20 includes overhead, longitudinally extending stationary rails 22 supported by structural members of a building, and a laterally extending traverse rail 24 supported on and movable longitudinally along the stationary rails. In one example the ends of traverse rail 24 are provided with wheels, not illustrated, that ride in a track of the stationary rails in order to achieve the longitudinal movability of the traverse rail. In this specification "longitudinal" and "lateral" are used merely to distinguish two orthogonal reference directions from each other.

Figure 3:
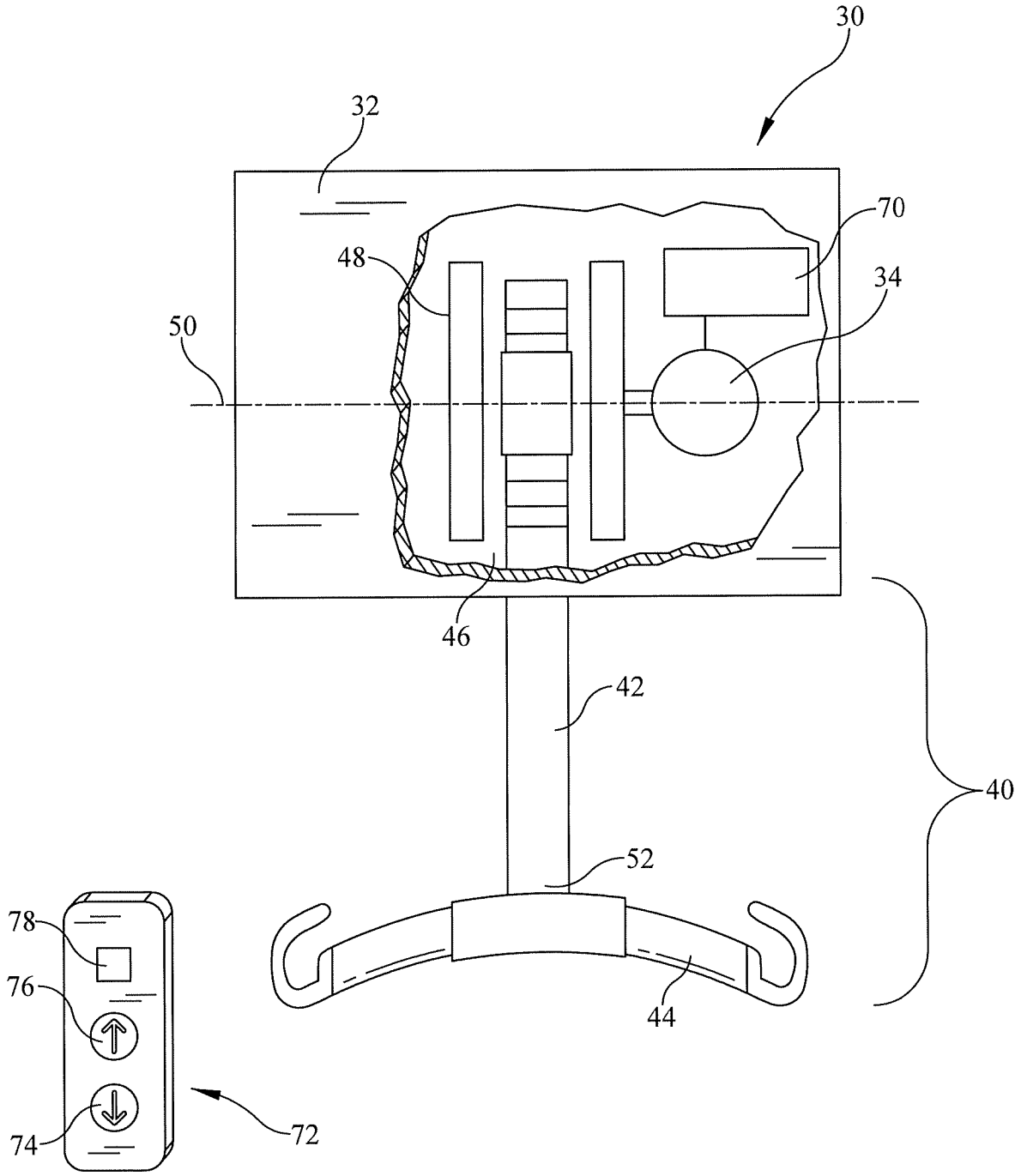
FIG. 3 is a view of selected components of a lift system including a hoist unit whose housing is partially broken away to expose components that reside inside the housing, a patient support assembly, and a control system comprised of a processor and a hand-held stand alone user interface having three user interface elements in the form of push buttons.

Referring additionally to FIG. 3, the lift system also includes a hoist module 30 which includes a housing 32 and a reversible motor 34. The hoist module is mounted on the traverse rail so that the hoist module is movable along the length of the rail, i.e. laterally. In one example, as seen schematically in FIG. 2, the hoist module includes wheels 36 that ride in a track of the traverse rail to achieve movability of the hoist module along the traverse rail.

The lift system also includes a patient support assembly 40. The illustrated patient support assembly includes a flexible tether 42 and a rigid slingbar 44. The illustrated tether has a first end 46 anchored to a spool 48 which resides inside housing 32 and is rotatable by motor 34 about rotational axis 50. The tether also has a second or free end 52. The slingbar is attached to the free end of the tether. (As seen best in FIG. 13, attachment of the slingbar to the tether may be affected by a two-part connector 54 which enables the slingbar to pivot about mutually orthogonal axes R, P, Y.) Operation of motor 34 causes the spool to rotate about its rotational axis thereby retracting the tether into or extending it out of housing 32 depending on the direction of motor rotation and consequently raising or lowering the slingbar. As shown in FIG. 2, the lift system also includes a sling 60 which cradles the person requiring assistance and which can be attached to and removed from the slingbar.

Figure 4:
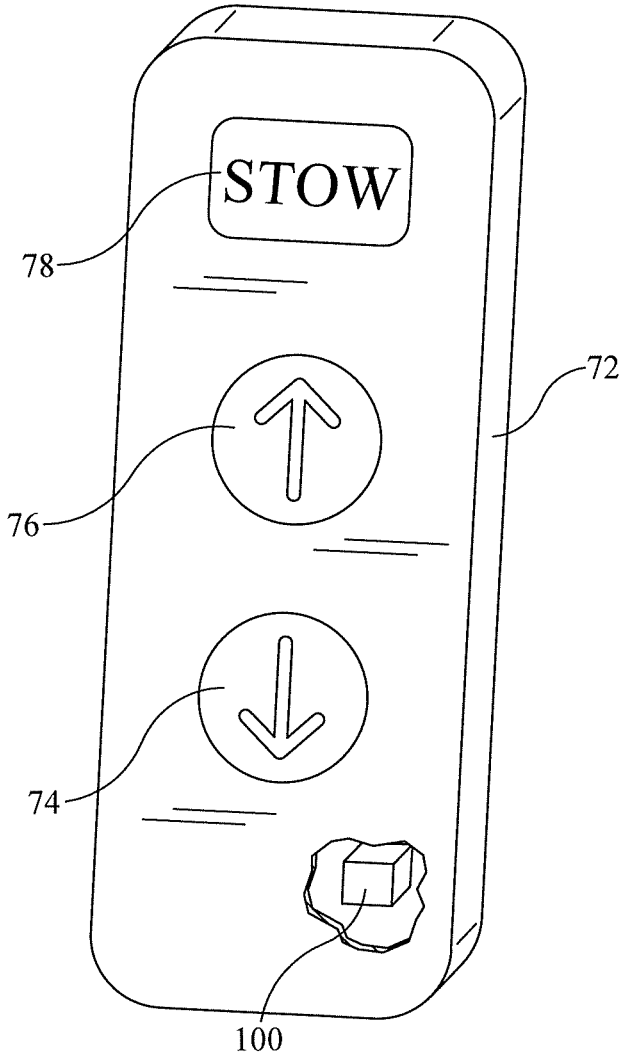
FIG. 4 is a magnified view of the user interface of FIG. 3 in which one of the buttons is an UP button (upwardly pointing arrow), one is a DOWN button (downwardly pointing arrow) and one is a STOW button dedicated to a stowage function, a portion of the user interface being broken away to show an accelerometer useful in one embodiment of the lift system.

Referring additionally to FIG. 4, The lift system also includes a control system comprised of a processor 70 and a user interface 72. The illustrated user interface is a hand-held remote controller, which is sometimes referred to as a pendant. The illustrated user interface communicates wirelessly with the processor as is suggested by the absence of a physical connection between the two in the drawing. The control system includes one or more user interface elements adapted to enable a user to issue operational commands. In general, a user interface element is a component or element of the user interface that the user interacts with (i.e. actuates) for example by pressing or touching, in order to issue a command. The illustrated user interface includes two operational user interface elements, namely first or DOWN button 74, and second or UP button 76. The illustrated user interface also includes STOW button 78 which is used to enable issuance of a stowage command, as distinct from an operational command.

In order to raise the support assembly, a user actuates UP button 76 by pressing and holding it until the support assembly reaches the desired higher elevation, at which time the user releases the UP button. In order to lower the support assembly, the user actuates DOWN button 74 by pressing and holding it until the support assembly reaches the desired lower elevation, at which time the user releases the DOWN button. The desired elevation is selected on an event by event basis by the user and may depend on the patient transport task being carried out (e.g. lifting the patient from a wheelchair to a bed) or the user's desire to elevate the support assembly to a user selected parking elevation as described earlier in this specification. Actuation of a button is referred to herein as the issuance of a command. A command which a user issues in order to move the tether and slingbar to a user selected height is referred to herein as an operational command. The user selected height is similarly referred to as an operational height or an operational destination or an operational elevation. The button used is similarly referred to as an operational button.

Thus, by reason of the UP and DOWN buttons of user interface 72 and the logic used by processor 70 in response to user actuation of the UP and DOWN buttons, the control system is adapted to enable a user to issue an operational command which causes the support assembly to move to an operational destination. In particular, the first interface element (UP button 76) enables issuance of a first operational command and the second interface element (DOWN button 74) enables issuance of a second operational command. Because the UP and DOWN buttons are momentary switches, the corresponding operational commands remain in effect only as long as the user maintains actuation of the button by continuing to apply pressure to the button.

STOW button 78 is a latching switch which is dedicated to issuance of a stowage command for stowing the slingbar at a predefined stowage elevation. User actuation of the STOW button (turning the switch to its on state) causes processor 70 to operate motor 34 in the appropriate direction to raise the tether and slingbar to the predefined stowage destination. Because button 78 is a latching switch, the stowage command resulting from its actuation does not require sustained action (e.g. the "holding" portion of "pressing and holding") on the part of the user to remain in effect. Instead button 78 is a "press and release" button. When the tether and slingbar arrive at the stowage destination the processor logic commands the switch 78 to return to its off state. The speed at which motor 34 operates in response to a stowage command may be faster than the speed at which the motor operates in response to an operational command to raise the patient support assembly.

By reason of the presence of STOW button 78 and the logic used by processor 70 in response to user actuation of the STOW button, the control system is adapted to enable a user to issue a command (by way of actuating the STOW button) which causes the support assembly to move from its initial position to a destination which is predefined to be a stowage destination. "Predefined" means that the destination is not arbitrarily chosen by the user. Instead the destination is selected by the system designer(s) as a destination suitable for stowage of the tether and slingbar, although it may be field adjustable to accommodate contingencies. The command issued by way of STOW button 78 is referred to as a STOW command.

Figure 5:
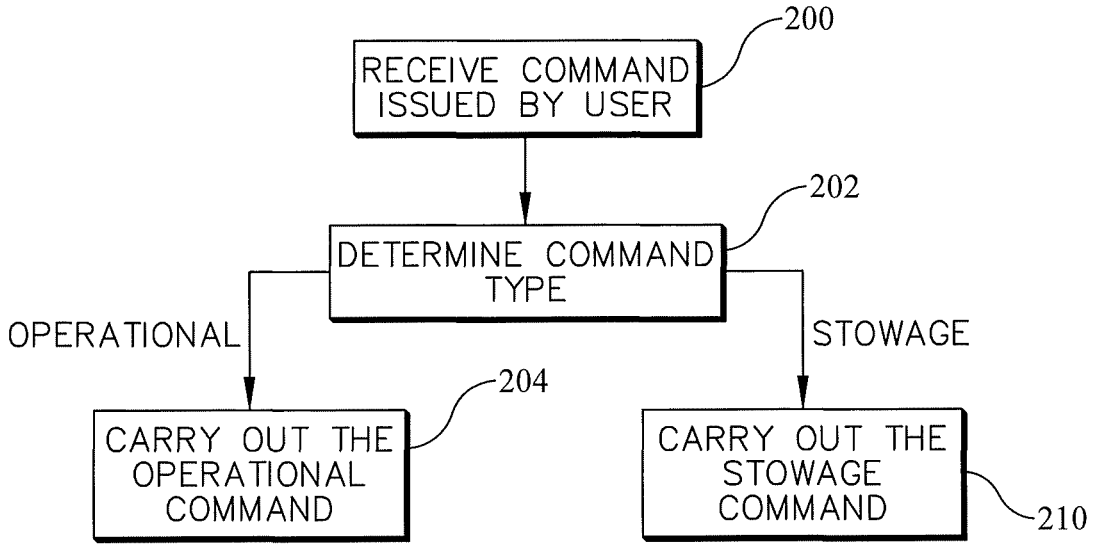
FIG. 5 is a block diagram showing operation of a lift system in either an operational mode or a stowage mode depending on the type of user command issued by a user.

As is evident from the foregoing, the control system comprised of user interface 72 of FIG. 4 and processor 70 is designed to enable the user to issue an operational command by way of UP or DOWN buttons 76, 74, thereby causing the patient support assembly to move to an operational destination. Additionally, the control system is designed to enable the user to issue a stowage command by way of actuation of an interface element (STOW button 78) dedicated to issuance of the stowage command. This is illustrated in block diagram form in FIG. 5. At block 200 the control system receives a command issued by a user using the user interface elements. At block 202 the control system determines if the issued command is an operational command or a stowage command. If the former, the control system branches to block 204 and carries out the operational command. If the latter, the control system branches to block 210 and carries out the stowage command.

Figure 6:
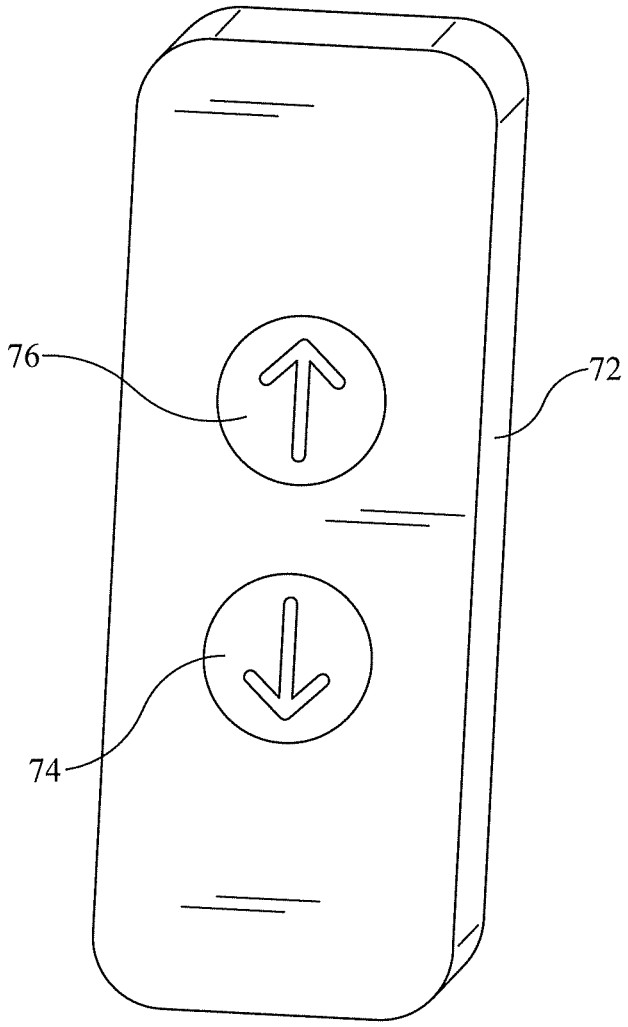
FIG. 6 is a view of a user interface similar to that of FIG. 4 but having only an UP button and a DOWN button.
Figure 7:
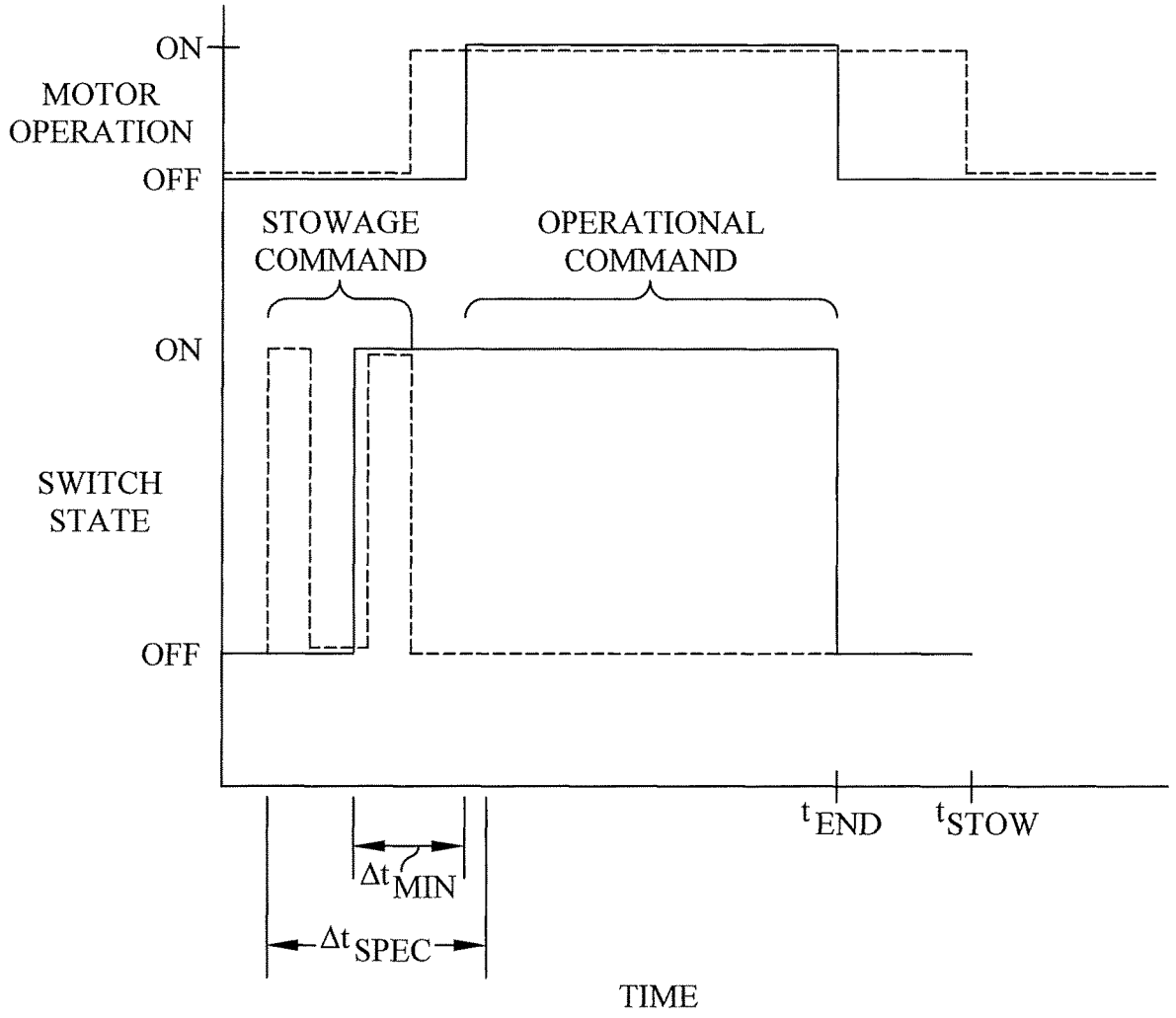
FIG. 7 is a graph showing how a user can maintain pressure on the UP button of FIG. 6 to issue either an operational command corresponding to the left branch of FIG. 5 or can press the switch two times in rapid succession to issue a STOW command corresponding to the right branch of FIG. 5.

FIG. 6 shows an embodiment of a user interface which does not include a dedicated button that a user can use to issue the stowage command. The user interface includes only UP button 76 and DOWN button 74. At least one of the buttons, for example UP button 76, is a shared interface element. Button 76 is referred to as a shared button because it enables the user to issue either an operational command or a stowage command depending on the way it is used. As seen in the example of FIG. 7, solid line, the logic of processor 70 may be designed to interpret a single "press and hold" actuation of UP button 76 lasting at least a minimum time interval $\Delta t_{MIN}$ as an operational command. The processor will cause motor 34 to operate to raise the tether and slingbar as long as the user maintains pressure on the button. i.e. until the user withdraws the operational command by releasing button 76 at time $t_{END}$.

The logic of processor 70 is additionally designed to interpret actuation of the shared button in a different way (a way not compatible with the issuance of the operational command) as a stowage command. One example of actuation of the shared interface element in a way not compatible with issuance of the operational command is repetitive actuation of the shared element within a specified time interval $\Delta t_{SPEC}$ (FIG. 7, dashed line). The processor interprets the repetitive actuation as if it were a signal from a latching switch to move the patient support assembly to the stowage destination. Once the support assembly arrives at the stowage destination at time $t_{STOW}$ the processor commands the motor to cease operating.

Thus, by reason of the UP button of user interface 72 and the logic used by processor 70 in response to different modes of user actuation of the UP button, the control system is adapted to enable a user to issue an operational command which causes the support assembly to move to an operational destination. The control system is additionally adapted to enable the user to issue a stowage command, which causes the patient support assembly to move to a stowage destination. The control system recognizes one mode of actuation of the UP button (press and hold) as an operational command, and another mode of actuation of the UP button (repetitive operation within a specified time interval) as a stowage command.

The foregoing description of the shared nature of the UP button and the controller logic which distinguishes among different modes of actuation of the UP button is equally applicable to the DOWN button. For example, the logic of processor 70 could be set up to interpret one mode of actuation of DOWN button 74 as an operational command and another mode of operation as a command to lower the tether and slingbar from an initial elevation to a prescribed lower elevation.

Figure 8:
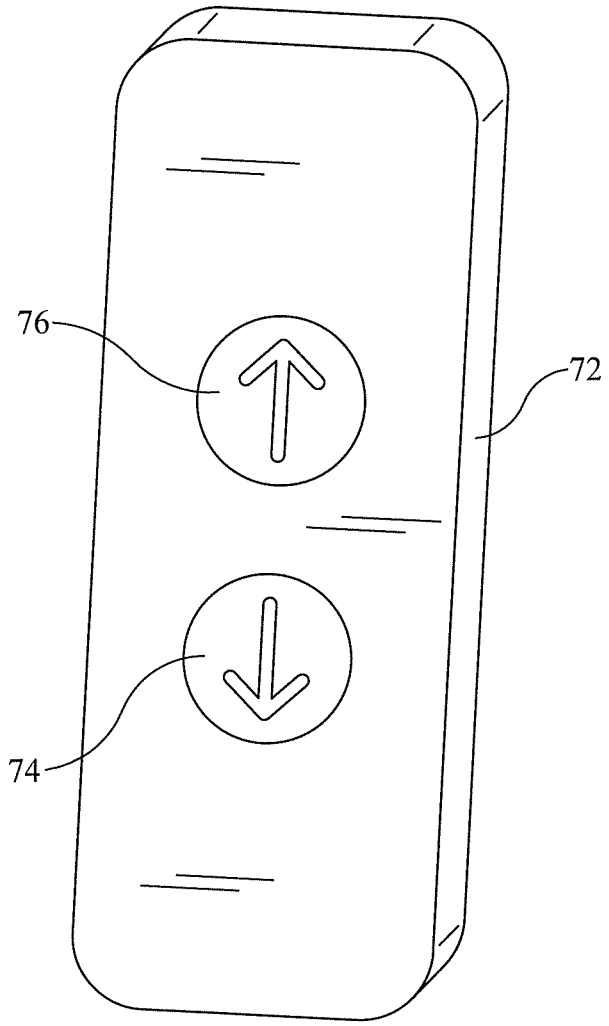
FIG. 8 is a view of a user interface whose external physical appearance is the same as that of FIG. 6, but which is configured to be used in a different way to command stowage.

FIG. 8 shows another embodiment of a user interface which does not include a dedicated button that a user can use to issue a stowage command. The external physical appearance of the user interface of FIG. 8 is the same as that of the user interface of FIG. 6 in that the user interface of FIG. 8 includes only UP button 76 and DOWN button 74. Each button is a momentary switch that enables a user to issue an operational command when actuated nonconcurrently with the other button.

Figure 9:
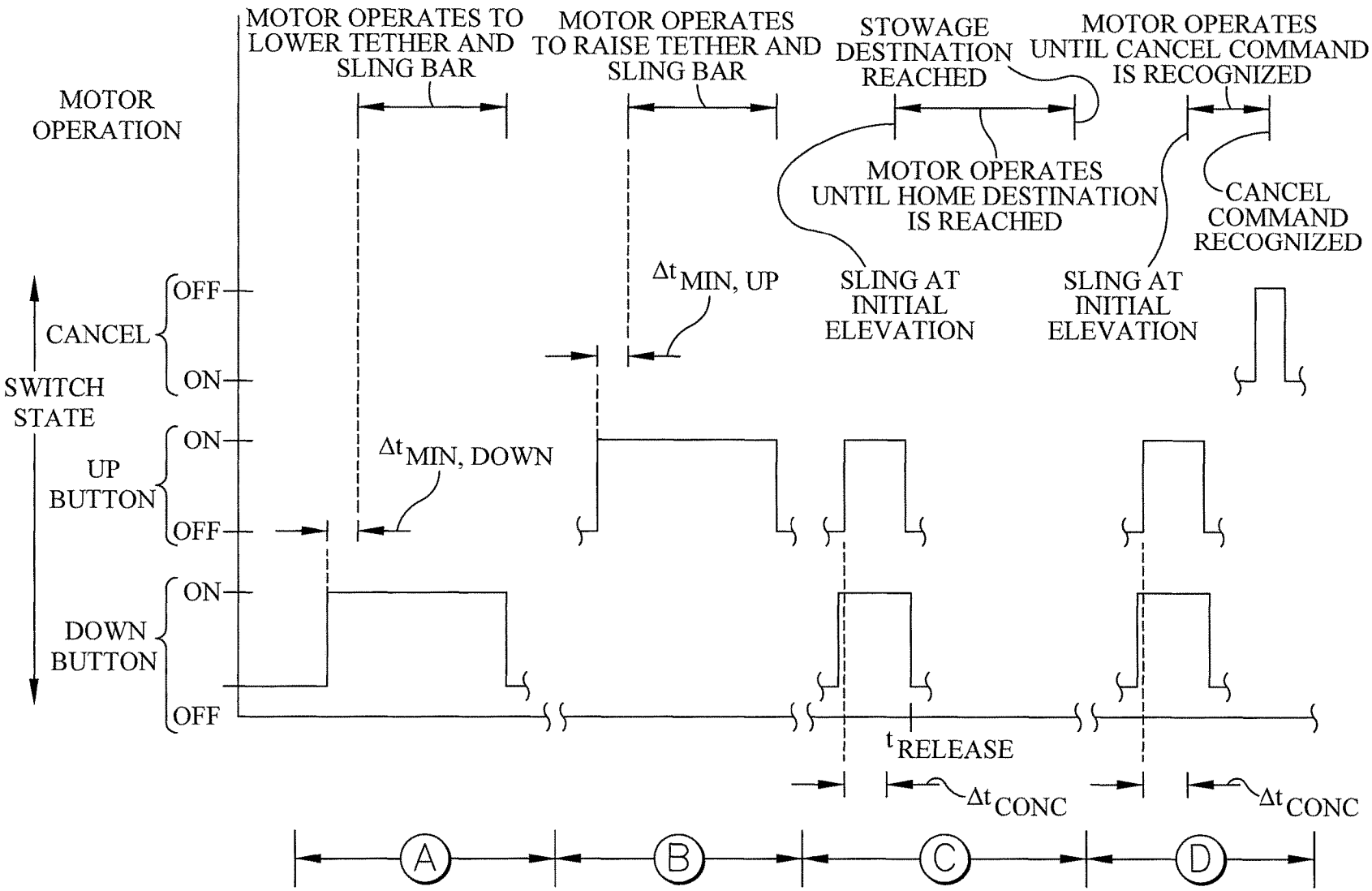
FIG. 9 is a graph showing how a user can maintain pressure on either the UP button or DOWN button of FIG. 8 to issue operational commands corresponding to the left branch of FIG. 5 or can actuate the UP and DOWN buttons concurrently to issue a stowage command corresponding to the right branch of FIG. 5, and also showing a command which cancels a previously issued stowage command.

Referring additionally to segment A of the graph of FIG. 9, the logic executed by processor 70 is designed to interpret "press and hold" actuation of the DOWN button lasting at least a minimum time interval $\Delta t_{MIN,DOWN}$ as an operational command to lower the tether and slingbar to a lower elevation as long as the user maintains pressure on the button (or until a lower limit is reached). Similarly, as seen in segment B of the graph, the logic executed by processor 70 is designed to interpret "press and hold" actuation of the UP button lasting at least a minimum time interval $\Delta t_{MIN,UP}$ as an operational command to raise the tether and slingbar to a higher elevation as long as the user maintains pressure on the button (or until an upper limit is reached).

As seen at segment C of the graph the logic executed by the processor is additionally designed to interpret concurrent actuation of the UP and DOWN buttons as a stowage command. As illustrated in FIG. 9 the designer has imposed the constraint that the actuation of the two buttons must have a temporal overlap of at least $\Delta t_{CONC}$ in order for the processor to recognize the actuations as concurrent. The concurrent actuation of the two buttons is interpreted by the processor logic as if it were a signal from a latching switch. As a result, the processing logic continues to allow the motor to operate even after the user has released both buttons at time $t_{RELEASE}$.

Thus, by reason of the presence of the UP and DOWN buttons of user interface 72 and the logic used by processor 70, the control system is adapted to enable a user to issue operational commands to raise or lower the tether and slingbar by nonconcurrent actuation of the UP and DOWN buttons. In other words, nonconcurrent actuation of the UP and DOWN buttons does not constitute issuance of a stowage command. The control system is additionally adapted to enable the user to issue a stowage command by concurrent actuation of those same two buttons.

The user interface and/or processor logic may be designed so that the stowage command remains in force until the tether and slingbar arrive at the stowage destination (FIG. 9, segment C), or may be designed to enable the user to issue a command to cancel the stowage command before the tether and slingbar arrive at the stowage destination (FIG. 9, segment D). The user interface and the logic used by the processor to enable the user to issue a cancel command may take a variety of forms. These include but are not limited to 1) a dedicated CANCEL button and associated processor logic and 2) alternate ways of using interface elements that are assigned to some other primary function, once again with appropriate processor logic.

As noted previously a user who operates a lift system with a stand alone user interface, which is in the form of a latching switch or mimics a latching switch, may make the mistake of actuating the switch and then placing the user interface at a storage site on the patient support assembly while the storage site is still within reach. The user interface can then travel with the support assembly to its stowage destination, which may be high enough to put the user interface out of reach of the next person who wishes to use it.

Figure 10:
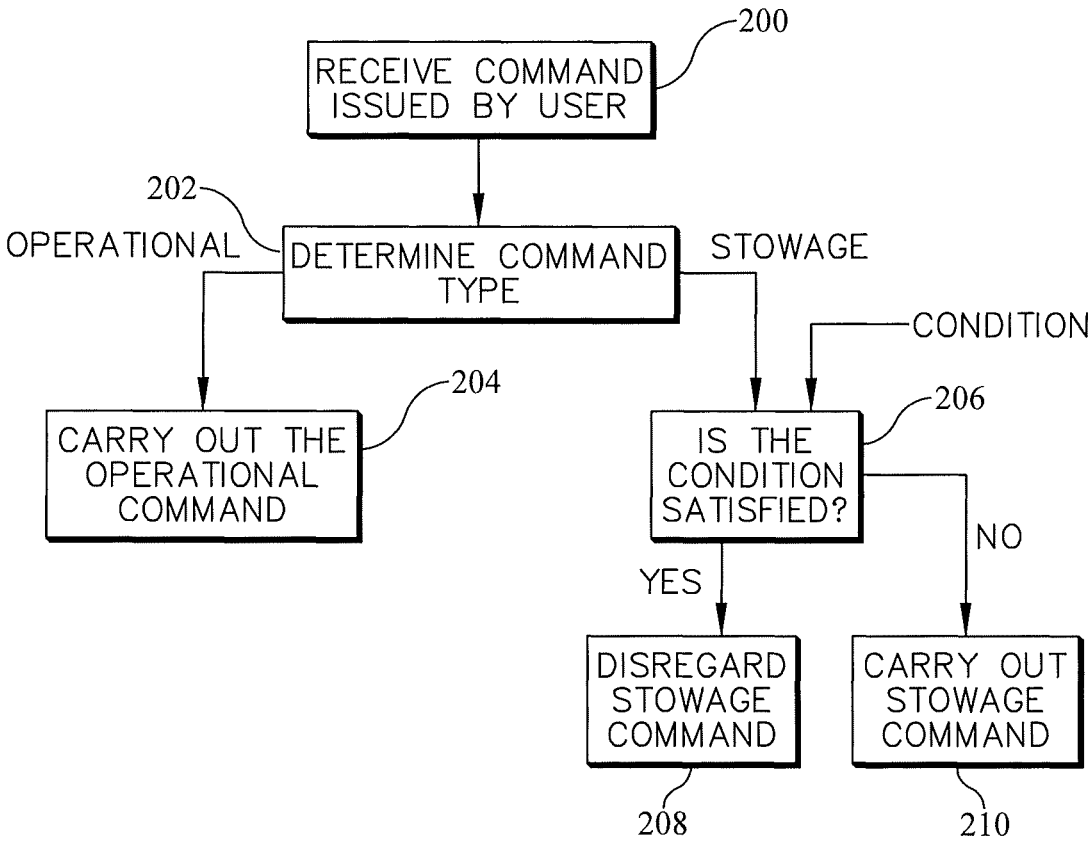
FIG. 10 is a block diagram similar to that of FIG. 5 showing conditional execution of a stowage command.

FIG. 10 shows operation of a lift system that overcomes the "out of reach" problem by disregarding the stowage command provided at least one condition is satisfied. Blocks 200, 202 and 204 are the same as blocks 200, 202, 204 of FIG. 5. However, if the control system determines at block 202 that the issued command is a stowage command, it branches to block 206 and assesses whether or not a condition which would contraindicate execution of the stowage command has been satisfied. If so the control system branches to block 208 and disregards the stowage command. If not the control system branches to block 210 and carries out the stowage command.

The phrase "disregarding the stowage command . . . provided at least on condition is satisfied", and similar phrases means to not carry out the stowage command if, at the time the command is issued, the condition is satisfied. The phrase should be understood to also include discontinuing execution of the stowage command if the condition becomes satisfied after execution of the command is already underway (due to the condition not having been satisfied at the time the command was issued). Moreover, discontinuing execution of the stowage command may include, if desired, operating the motor to return patient support assembly 40 to its initial elevation (the elevation it had been at when the stowage command was first issued) without further action on the part of the user.

Figure 11:
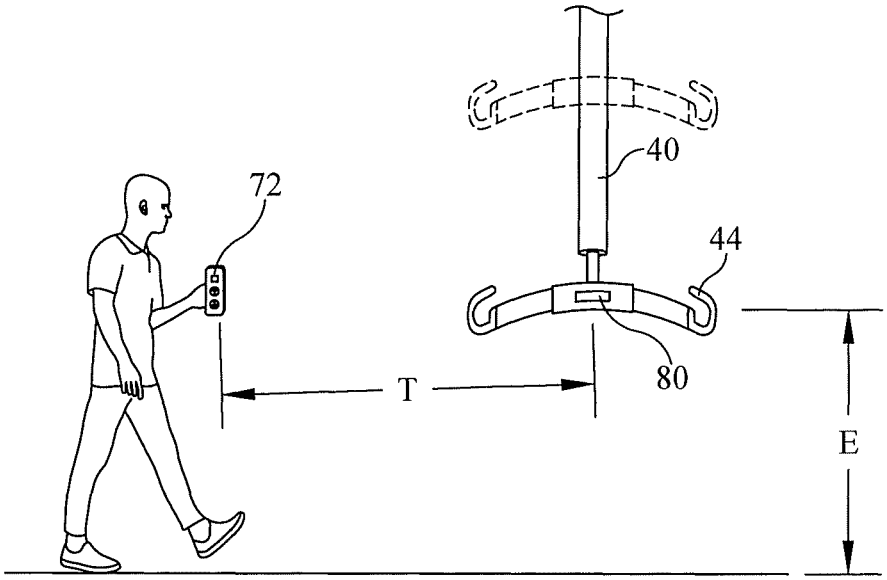
FIG. 11 is an illustration depicting an embodiment in which the condition for disregarding the stowage command is that the user interface and a component of the support assembly are spatially separated from each other by less than a threshold spacing T.
Figure 12:
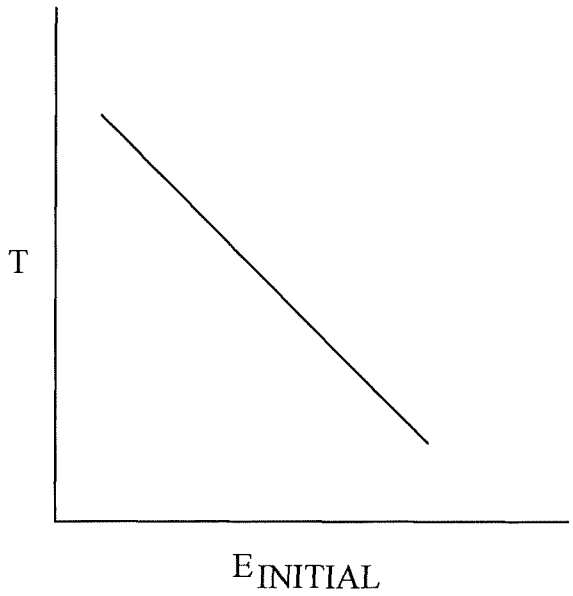
FIG. 12 is a graph showing an example in which the threshold spacing of FIG. 11 is a function of an elevation $E_{INITIAL}$ of a component of the support assembly at the time the stowage command is estimated to have been issued.

Referring to FIG. 11, in one embodiment the condition for disregarding the stowage command is that the user interface and the support assembly are spatially separated from each other by less than a threshold spacing T. For values of separation larger than T, the user is considered to be far enough away from user interface storage site 80 on the patient support assembly that if he issued a stowage command, the storage site would be out of reach (e.g. as shown in phantom) before he could be near enough to store the user interface at the storage site. If desired the threshold may be expressed as a function of the elevation $E_{INITIAL}$ of the storage site at the time the stowage command is estimated to have been issued. FIG. 12 shows an example relationship between threshold T and initial elevation $E_{INITIAL}$, however the relationship need not be linear. Technologies for sensing proximity include RFID proximity sensors and Hall Effect proximity sensors, to name just two.

Figure 13:
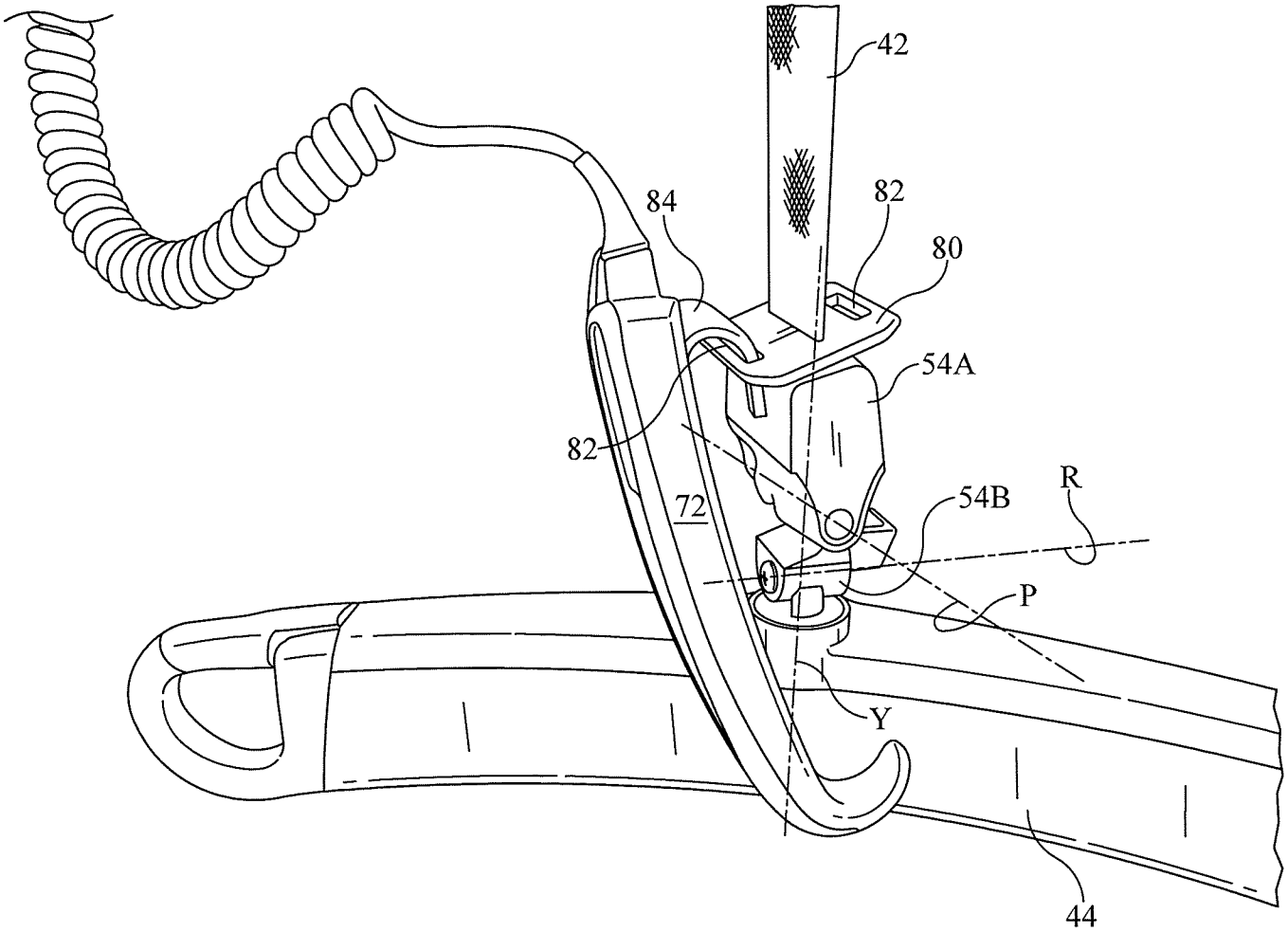
FIG. 13 is an illustration of a user interface having a hook portion hooked onto a storage site which is in the form of a collar on the patient support assembly.
Figure 14:
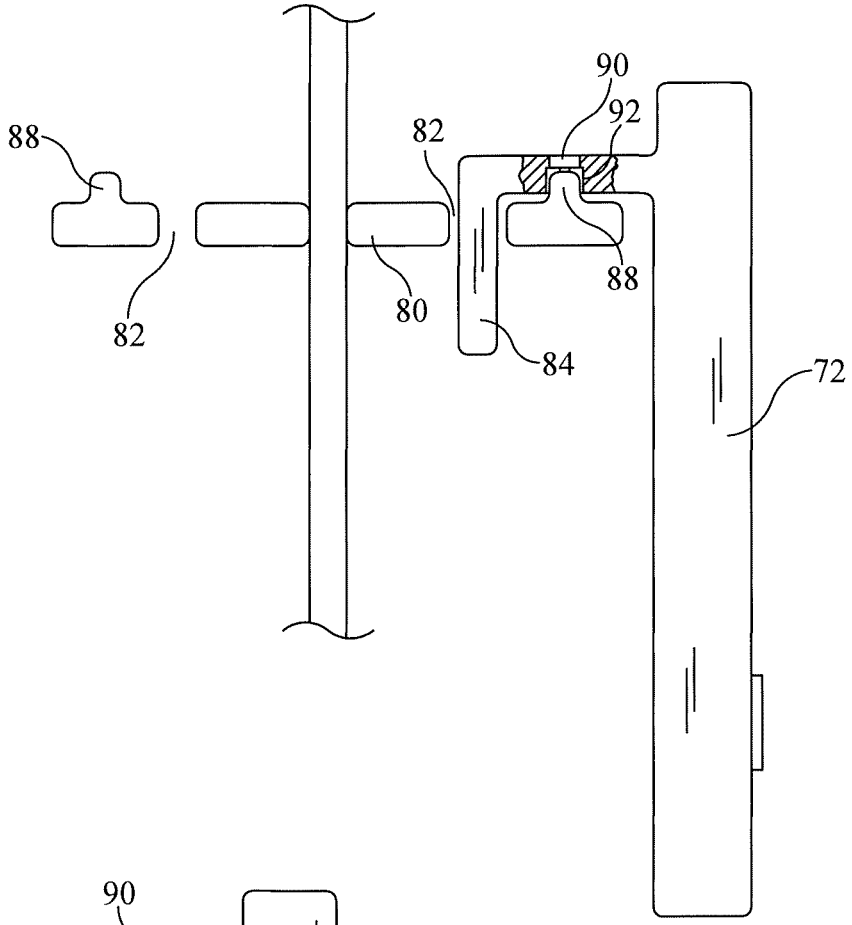
FIG. 14 is a schematic side elevation view to that of FIG. 13 in which the hook portion of the user interface includes a switch, the collar includes a projection, and showing the switch in a closed state due to the user interface having been hooked onto the collar.
Figure 15:
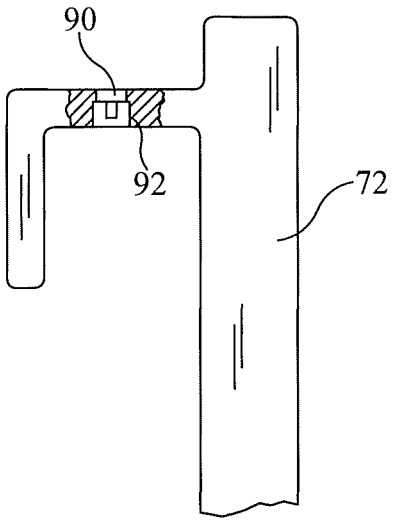
FIG. 15 is a view of the user interface of FIG. 14 showing the switch in an open state due to the user interface having been removed from the storage site.

Referring to FIG. 13, in another embodiment the condition for disregarding the stowage command is that the user interface is stored at the storage site of the patient support assembly. In FIG. 13, the storage site is a collar 80 having slots 82 that receive a hook portion 84 of user interface 72. FIGS. 14-15 show an embodiment in which the collar includes a projection 88 outboard of each slot. Hook portion 84 of the user interface includes a switch 90 and an opening 92. When a user hangs the user interface on the collar the projection projects into the opening and closes the switch (FIG. 14). When the user interface is not hanging on the collar the switch is open (FIG. 15). The state of the switch, closed or open, is reported to the processor which uses the known switch polarity to make the determination at block 206 of FIG. 10. If the switch is closed the processor follows the YES path to block 208 and disregards any stowage command received at block 200. If the switch is open the processor follows the NO path to block 210 and carries out the stowage command.

Figure 16:
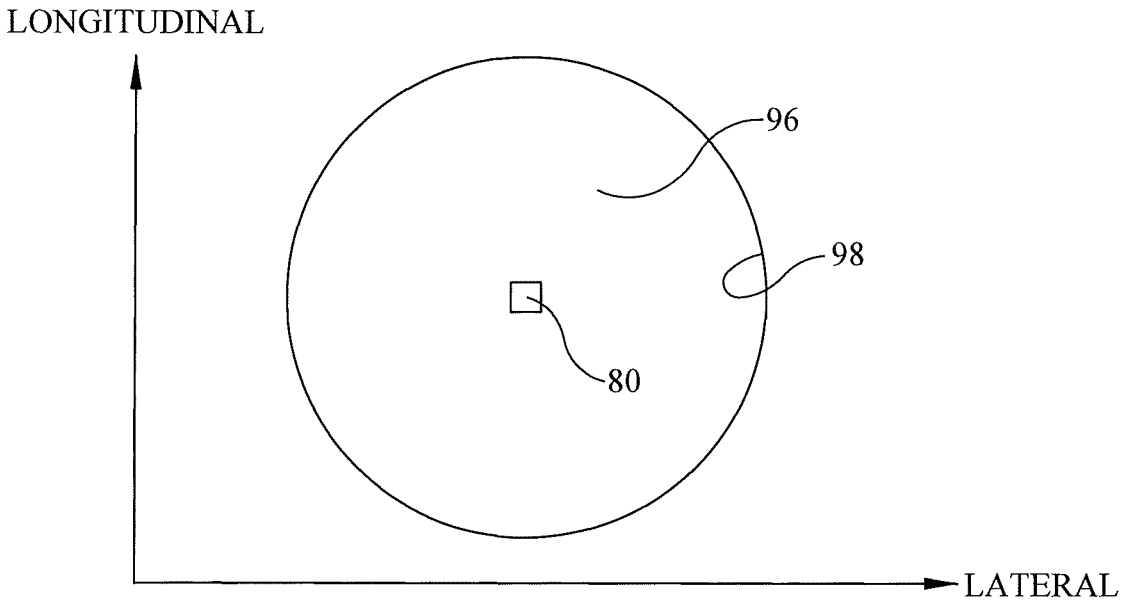
FIG. 16 is a plan view showing the lateral and longitudinal locations of a storage site of a patient support assembly and also showing a zone of proximity relative to the storage site.

In another embodiment the condition for disregarding the stowage command is nonpossession of the user interface by a user subsequent to the issuance of a stowage command. FIG. 16 is a plan view showing the lateral and longitudinal location (i.e. coordinates) of storage site 80 and a zone of proximity 96 bounded by boundary 98. In the plan view of FIG. 16 the illustrated boundary is a circle and therefore corresponds to a cylinder so that the zone is cylindrical. Other geometries may also be employed, such as a spherical zone.

Figure 17:
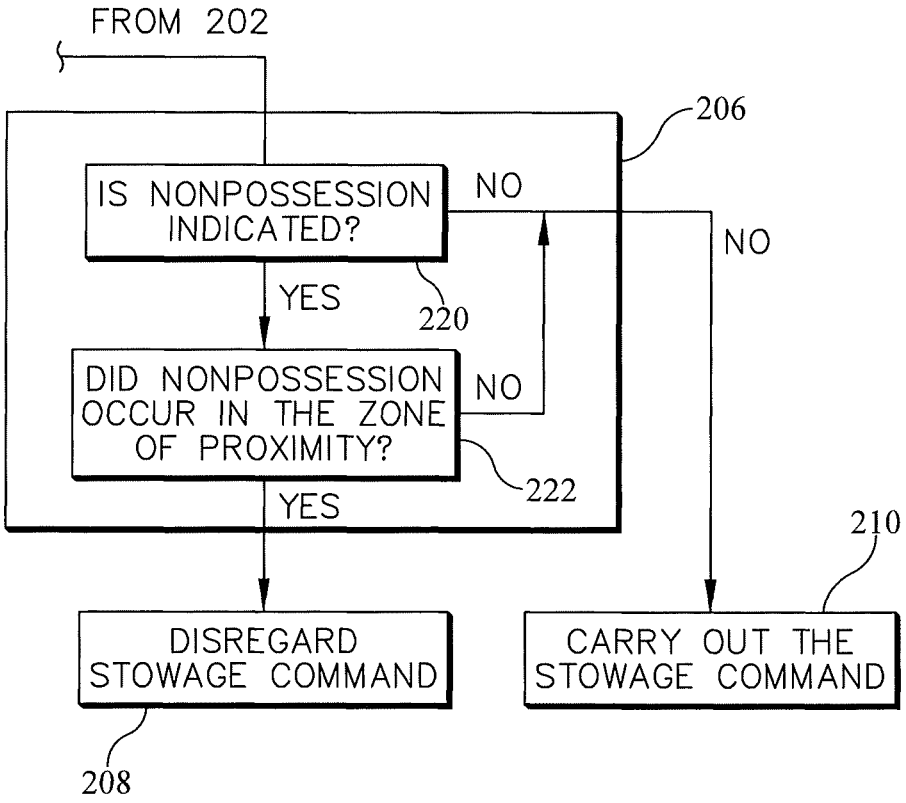
FIG. 17 is a partial block diagram similar to a portion of the diagram of FIG. 10 depicting an embodiment in which the condition for disregarding the stowage command is nonpossession of the user interface within the zone of proximity of FIG. 16.

FIG. 17 is a diagram showing sub-blocks of block 206 of FIG. 10. At sub-block 220 the control system determines if the user interface is in the possession of a user. Distinguishing between possession and nonpossession of the user interface by a person can be done in a variety of ways, for example by outfitting the user interface with thermal sensors which are sensitive to heat emission from a person's hand, pressure sensors which are sensitive to the pressure of a person's grip, or capacitive sensors. general, nonpossession is indicated by detecting conditions not consistent with the user interface being held in the hand of a user (e.g. lack of heat or lack of pressure).

If nonpossession is indicated at block 220 the control system follows the YES path to block 222 where it is determined if, at the time the nonpossession was detected, the user interface was within zone of proximity 96. Satisfaction of both of these subconditions is a suggestion (although not a guarantee) that the nonpossession may have occurred because the user, after issuing the stowage command, and because of his proximity to the storage site, may have stored the user interface at the storage site while the slingbar was moving towards its stowed destination. Accordingly, the control system advances to block 208 and disregards the stowage command. If nonpossession is not indicated at block 206, or if the nonpossession did not occur within the zone of proximity, the control system advances to block 210 and carries out the stowage command. The fact that the user's nonpossession occurred outside the zone of proximity is suggestive that the nonpossession occurred because the user placed the user interface somewhere other than at the storage site on the tether or slingbar.

Figure 18:
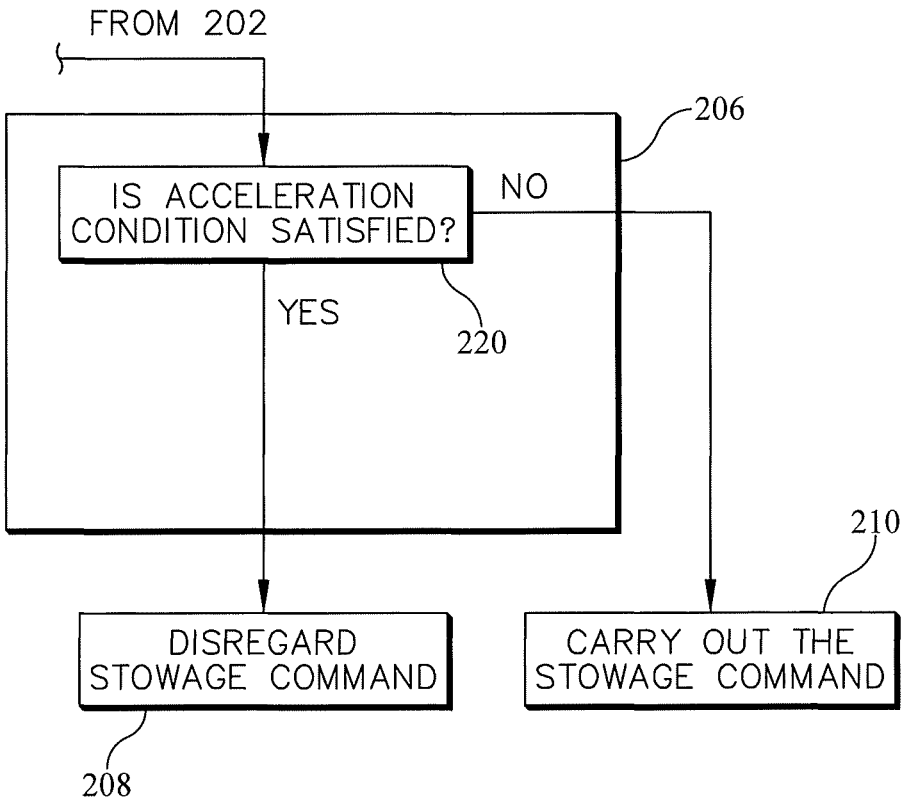
FIG. 18 is a partial block diagram similar to a portion of the diagram of FIG. 10 depicting an embodiment in which the condition for disregarding the stowage command is that an acceleration related condition is satisfied.

FIG. 18 is a diagram depicting sub-blocks of block 206 of FIG. 10 and showing an embodiment of an acceleration sensitive system. At sub-block 220 the control system determines if one or more acceleration criteria consistent with the user interface having been stored on patient support assembly 40 have been satisfied. If so the control system advances to block 208 and disregards the command. If not the control system branches to block 210 and carries out the stowage command.

Figure 19:
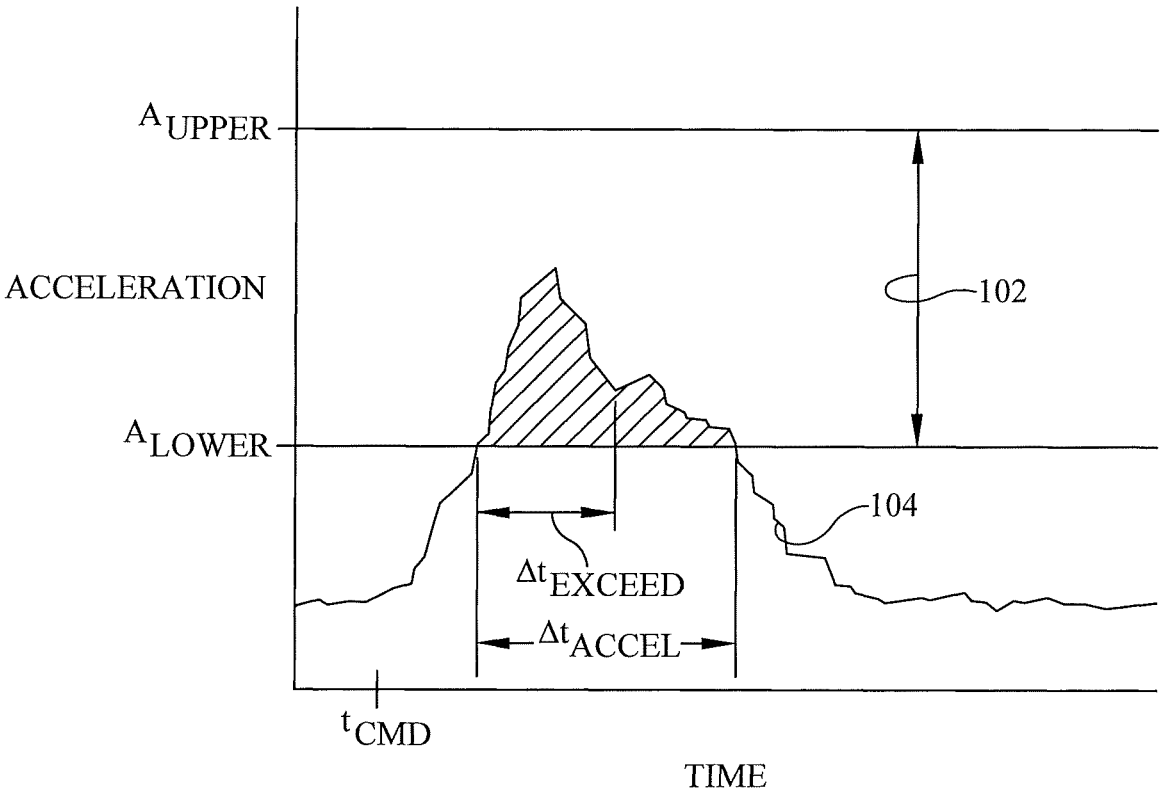
FIG. 19 is a graph illustrating possible options for the acceleration related criterion used in the block diagram of FIG. 18.

The graph of FIG. 19 illustrates possible options for acceleration related criteria which can be used at block 206 of FIG. 18. The graph shows upper and lower threshold values $A_{UPPER}$, $A_{LOWER}$ corresponding to a range 102 of acceleration values that lift assembly 40 is expected to experience just after motor 34 begins operating to stow the support assembly. At $t_{CMD}$ a user issues a stowage command. Motor 34 begins operating shortly thereafter. The time difference between command issuance and the onset of motor operation is typically small and therefore is not accounted for in the graph. The acceleration profile 104 detected by accelerometer 100 (FIG. 4) penetrates into zone 102. Because the acceleration profile exceeds lower acceleration threshold $A_{LOWER}$ but does not exceed upper threshold $A_{UPPER}$ during part of the start-up transient, i.e. during time frame $\Delta t_{ACCEL}$, the condition of block 220 of FIG. 18 is satisfied, and the stowage command is disregarded.

In a slightly different embodiment the control system does not test the acceleration profile against both an upper limit and a lower limit but instead disregards the stowage command based on nothing more than exceedance of $A_{LOWER}$. In other possible embodiments the control system disregards the stowage command only if the acceleration exceeds a lower limit for more than a specified exceedance time interval $\Delta t_{EXCEED}$ or if the area bounded by the acceleration profile and the lower limit (crosshatched in the illustration) exceeds a specified value.

Figure 20:
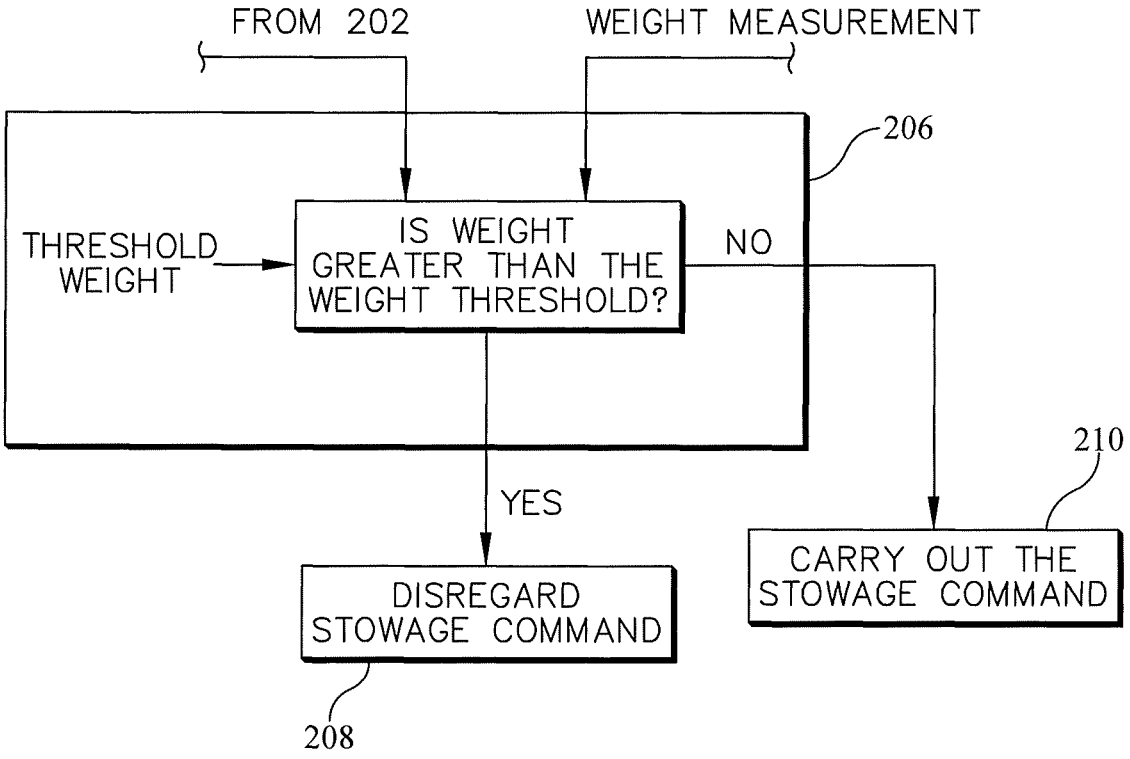
FIG. 20 is a partial block diagram similar to a portion of the diagram of FIG. 10 depicting an embodiment in which the condition for disregarding the stowage command is that a weight borne by the patient support assembly exceeds a weight threshold.

Referring to FIG. 20, in yet another embodiment the condition for disregarding the stowage command is that the support assembly is determined to be subject to a force greater than a specified maximum amount, for example a force large enough to suggest that the support assembly is bearing the weight of a patient. In another embodiment the force is a force sufficient to reveal that the user interface has been stored at a storage site on patient support assembly 40, for example as seen in FIG. 13. The weight supported by the support assembly may be determined by, for example, a strain gage installed in tether 42 or connector 54.

Figure 21A:
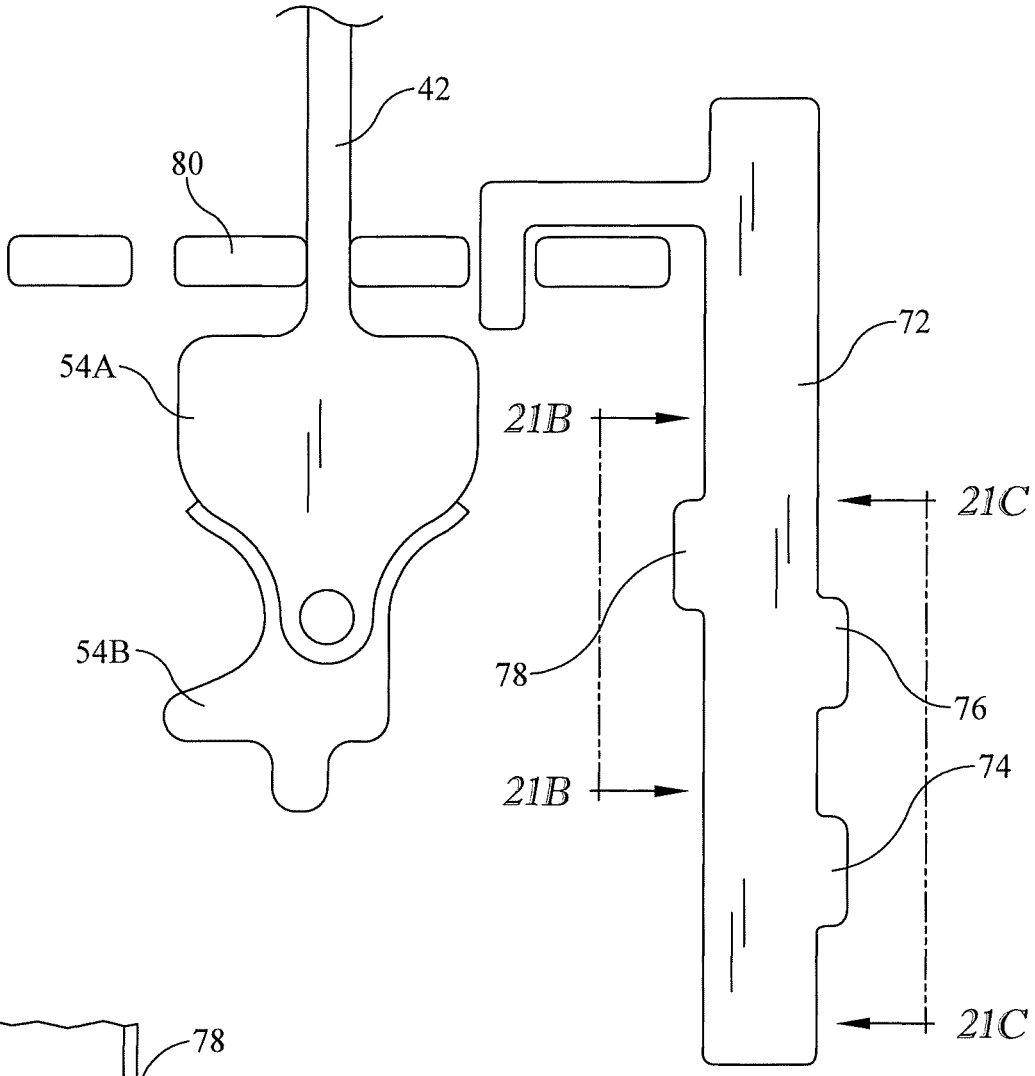
FIGS. 21A, 21B and 21C are schematic elevation views showing a user interface which encumbers issuance of a command to stow the patient support assembly.
Figure 21B:
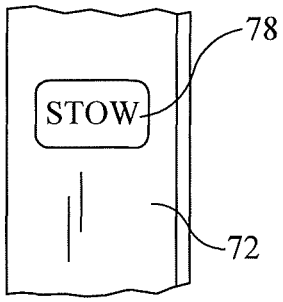
Figure 21C:
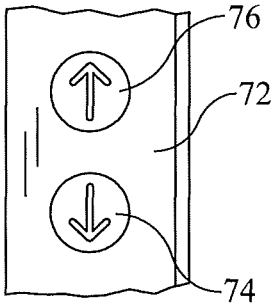

In other embodiments the "out of reach" problem is addressed by reason of the control system being adapted to encumber issuance of the stowage command. In the embodiment of FIGS. 21A through 21C, the user interface is designed so that the STOW button faces away from the user when the user interface is hooked onto collar 80. Use of the STOW button is therefore encumbered, at least when the user interface is hooked to the collar. Other locations for the STOW button, which make it awkward or inconvenient to actuate under certain circumstances may also be satisfactory. Additionally, or alternatively the user interface may be designed so that the force the user must apply to actuate the STOW button is relatively large in comparison to the actuation force required to operate the UP and DOWN buttons. The large actuation force may serve as a reminder to not store the user interface at the storage site after having issued a stowage command.

In general, the user interface is designed so that the user interface element or elements which the user actuates to issue the stowage command are positioned on the user interface and/or otherwise configured (e.g. by requiring a large actuation force) so that the element or elements are, under certain circumstances, poorly accessible and/or inconvenient to operate. The circumstances of interest are those under which execution of the stowage command is contraindicated, such as the user interface being present at the storage site. The definition of the circumstances under which execution of the stowage command is contraindicated is done by individuals involved in the design of the lift system, including the user interface.

There is no conflict in the user interface being adapted to enable the user to issue a stowage command but also being adapted to encumber issuance of the stowage command. The encumbrance need not be so severe as to interfere with any and all user attempts to issue a stowage command, nor does it need to be unconditional. The system designer can balance the capability for the user to issue a stowage command with the severity of the encumbrance and the circumstances under which the encumbrance is in effect.

Figure 22:
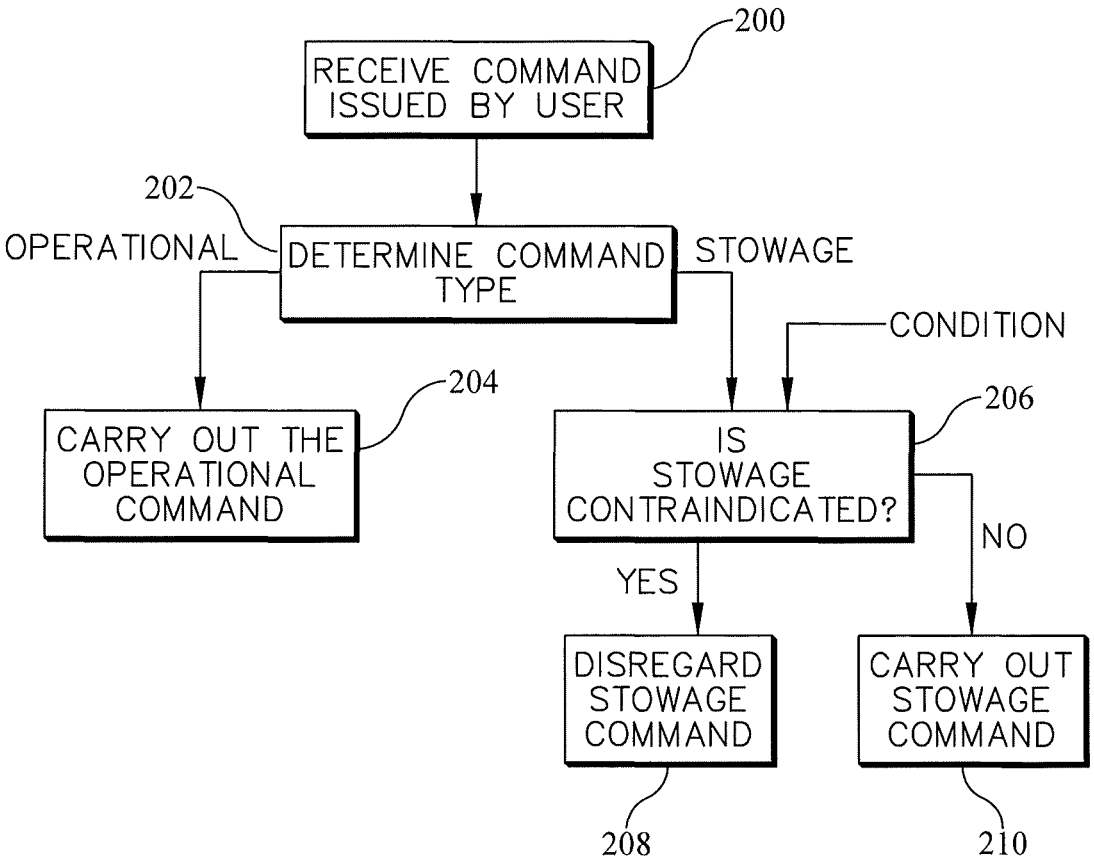
FIG. 22 is a block diagram similar to that of FIG. 10 illustrating a "disregard if contraindicated" point of view with respect to a stowage command.
Figure 23:
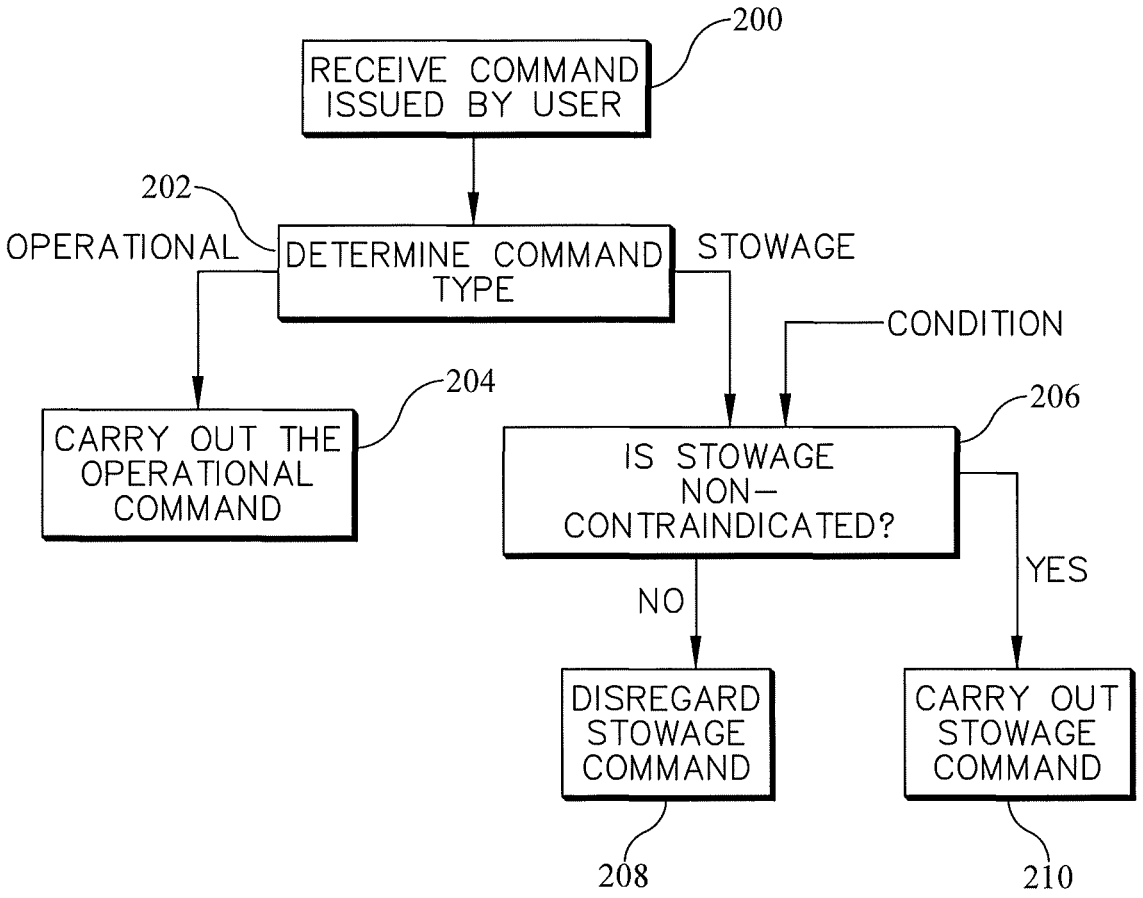
FIG. 23 is a block diagram similar to that of FIG. 22 illustrating an "execute if indicated" or, alternatively, an "execute if not contraindicated" point of view with respect to a stowage command.

The examples described above in this specification for disregarding a stowage command are based on a "disregard when contraindicated" point of view. That is, the stowage command is carried out unless doing so is contraindicated. This point of view is expressly shown at block 206 of FIG. 22. It is evident that the logic can be reversed to reflect an "execute when not contraindicated" or, alternatively, an "execute when indicated" point of view. This is shown at block 206 of FIG. 23 and by the fact that the YES and NO paths from block 206 of FIG. 23 are reversed in comparison to the analogous paths of FIG. 22.

Figure 24:
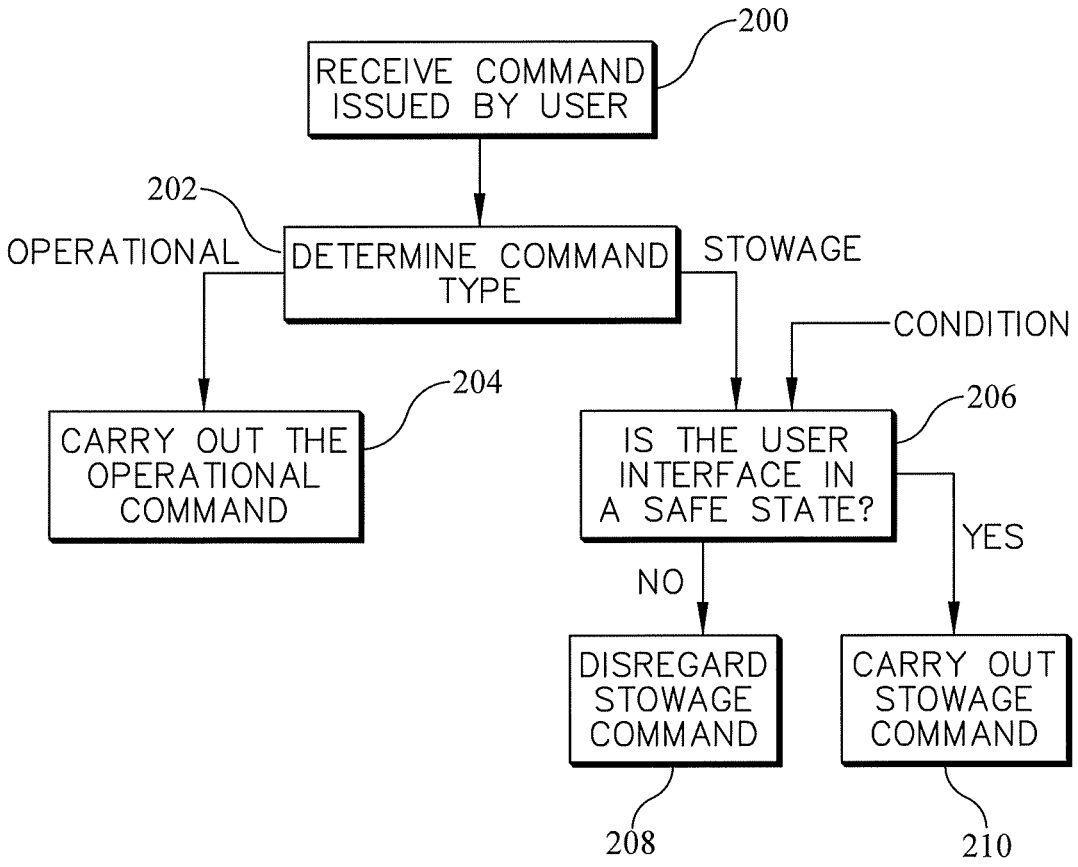
FIG. 24 is a block diagram similar to that of FIG. 23 showing a the "execute if not contraindicated" point of view embodied as a determination of whether the user interface is in a "safe" state.
Figure 25:
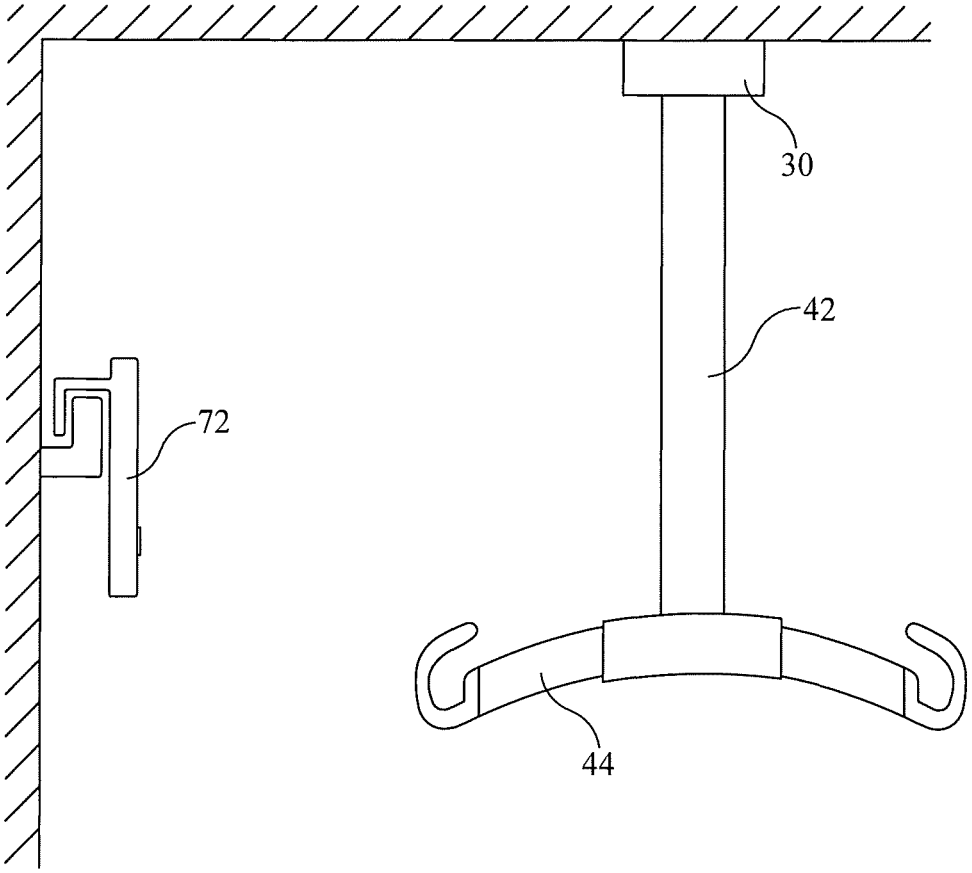
FIG. 25 is a schematic showing a specific example of the "execute if not contraindicated" philosophy.

FIG. 24 is a block diagram showing one example of the "execute when not contraindicated" point of view. At block 206 the control system determines if the user interface is in a "safe" state, i.e. is in a condition in which the "out of reach" problem will not occur as a consequence of carrying out the stowage command. If so, the control system follows the YES path to block 210 and executes the stowage command. If not, the control system follows the NO path to block 208 and declines to execute the stowage command. FIG. 25 shows a specific example in which the safe state corresponds to user interface 72 having been stored on a wall mounted hook at the time the user used the interface to issue the stowage command. In another example the open state of switch 90 of FIG. 15, if communicated to processor 70, could serve as an indication that the user interface is in a safe state.

Although this disclosure refers to specific embodiments, it will be understood by those skilled in the art that various changes in form and detail may be made without departing from the subject matter set forth in the accompanying claims.

We claim:

1. A lift system for a care recipient, comprising:

a hoist module;

a support assembly which is movable relative to the hoist module; and a control system comprising a user interface adapted to enable a user to:

a) issue an operational command which causes the support assembly to move to an operational destination;

b) issue a stowage command which causes the support assembly to move to a stowage destination;

the control system also adapted to:

A) assess that at least one condition is satisfied based on information received from at least one sensor, the at least one condition including the user interface being out of reach of the user, B) disregard the issued stowage command provided, and C) encumber issuance of the stowage command.

2. The lift system of claim 1, wherein the at least one condition further includes the user interface and the support assembly being spatially separated from each other by less than a threshold spacing.

3. The lift system of claim 1, wherein the at least one condition further includes the user interface being stored on the support assembly.

4. The lift system of claim 3, wherein the user interface includes a switch, a state of the switch indicating whether the user interface is stored on the support assembly.

5. The lift system of claim 1, wherein the at least one condition further includes nonpossession of the user interface by the user.

6. The lift system of claim 5, wherein the control system determines the nonpossession of the user interface by sensing conditions not consistent with the user interface being held in a hand of the user.

7. The lift system of claim 1, wherein the at least one condition further includes satisfaction of one or more criteria relating to acceleration of the user interface.

8. The lift system of claim 1, wherein the at least one condition further includes the support assembly being determined to be subject to a force greater than a specified maximum amount.

9. The lift system of claim 1, wherein the at least one condition further includes one or more user interface elements required for issuance of the stowage command being positioned on the user interface such that the element or elements are poorly accessible to a user or inconvenient for the user to operate under circumstances in which issuance of the stowage command is contraindicated.

10. The lift system of claim 1, wherein the user interface comprises one or more elements that are actuable to issue the stowage command are, under circumstances of interest, poorly accessible and/or inconvenient to operate.

11. The lift system of claim 10, wherein the circumstances of interest are those under which execution of the stowage command is contraindicated.

12. The lift system of claim 1, wherein the support assembly includes:

a tether which is retractable and deployable relative to the hoist module; and a slingbar attached or attachable to a free end of the tether.

13. The lift system of claim 1, wherein the control system is adapted to enable the user to issue the stowage command by way of one of:

a) operation of an interface element dedicated to issuance of the stowage command;

b) operation of at least one shared interface element in a way not compatible with issuance of the operational command; or c) concurrent operation of two or more interface elements, whose nonconcurrent operation does not constitute issuance of the stowage command.

14. The lift system of claim 13, wherein operation of the shared interface element in a way not compatible with issuance of the operational command is repetitive operation of the shared element within a specified time frame.

15. A lift system for a care recipient, comprising:

a hoist module;

a support assembly which is movable relative to the hoist module; and a control system comprising a user interface adapted to enable a user to:

a) issue an operational command which causes the support assembly to move to an operational destination;

b) issue a stowage command which causes the support assembly to move to a stowage destination;

the control system also adapted to:

A) assess whether at least one condition is satisfied based on information received from at least one sensor, the at least one condition including the user interface being out of reach of the user;

B1) disregard the issued stowage command provided when the at least one condition is satisfied, or B2) execute the issued stowage command provided when the at least one condition is not satisfied, and/or C) encumber issuance of the stowage command.

16. A lift system for a care recipient, comprising:

a hoist module;

a support assembly which is movable relative to the hoist module; and a control system which includes one or more operational interface elements adapted to enable a user to issue a first operational command to increase elevation of the support assembly and a second operational command to decrease elevation of the support assembly, the first operational command and the second operational command each remaining in effect only as long as the user maintains actuation of the interface element;

the control system also adapted to enable the user to issue a stowage command which, upon being issued, does not require sustained action on the part of the user to remain in effect, wherein, when the control system assesses that the one or more operational interface elements are out of reach of the user based on information received from at least one sensor, the control system disregards the issued stowage command.

17. The lift system of claim 16, wherein the one or more operational interface elements includes a first operational interface element adapted to enable issuance of the first operational command and a second operational interface element adapted to enable issuance of the second operational command.

18. The lift system of claim 17, wherein the first operational interface element is a shared interface element operable in a first mode and a second mode, and wherein the control system is adapted so that operation of the shared interface element in the first mode enables issuance of the first operational command, and so that operation of the shared interface element in the second mode enables issuance of the stowage command.

19. The lift system of claim 18, wherein the first mode is a press and hold mode and the second mode is repetitive actuation of the shared element within a specified time interval.

20. The lift system of claim 17, wherein the control system is adapted so that concurrent actuation of the first and second operational interface elements enables issuance of the stowage command.

21. The lift system of claim 16, wherein the one or more operational interface elements includes a stowage interface element by way of which one or more operational interface elements is adapted to enable issuance of the stowage command, and which is dedicated to enabling issuance of the stowage command.

22. The lift system of claim 16, wherein the one or more operational interface elements includes a stowage interface element which differs from other ones of the one or more operational interface elements and by way of which the stowage interface element is adapted to enable issuance of the stowage command.

23. The lift system of claim 16, wherein the control system is also adapted to enable the user to cancel the stowage command.

24. The lift system of claim 16, wherein the control system is also adapted to encumber issuance of the stowage command.

* * * * *